US008848955B2

(12) United States Patent
Courtois et al.

(10) Patent No.: US 8,848,955 B2
(45) Date of Patent: Sep. 30, 2014

(54) DEEP-EAR-CANAL HEARING DEVICE

(75) Inventors: David Courtois, Bessancourt (FR); Anton Gebert, Kleinsendelbach (DE); Que Huy Luu, Villepinte (FR); Frank Naumann, Erlangen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 282 days.

(21) Appl. No.: 13/150,381

(22) Filed: Jun. 1, 2011

(65) Prior Publication Data

US 2011/0293125 A1 Dec. 1, 2011

(30) Foreign Application Priority Data

Jun. 1, 2010 (DE) ..... 10 2010 022 323

(51) Int. Cl.
*H04R 25/00* (2006.01)

(52) U.S. Cl.
CPC ..... *H04R 25/604* (2013.01); *H04R 2225/023* (2013.01)
USPC ..... 381/324; 381/322; 381/328

(58) Field of Classification Search
USPC ..... 381/380, 328, 322, 324
See application file for complete search history.

(56) References Cited

U.S. PATENT DOCUMENTS 5,357,576 A * 10/1994 Arndt ..... 381/328
6,516,074 B1 * 2/2003 Brimhall et al. ..... 381/322
6,724,902 B1 * 4/2004 Shennib et al. ..... 381/328
6,865,279 B2 3/2005 Leedom
7,536,023 B2 5/2009 Leedom et al.
7,720,242 B2 * 5/2010 Anderson et al. ..... 381/328
8,229,151 B2 * 7/2012 Saltykov et al. ..... 381/328
8,340,335 B1 * 12/2012 Shennib ..... 381/328
8,379,895 B2 * 2/2013 Gebert et al. ..... 381/322
2002/0006209 A1 1/2002 Mahoney et al.
2003/0059074 A1 * 3/2003 Olsen ..... 381/322
2005/0074138 A1 4/2005 Saltykov
2007/0036379 A1 2/2007 Anderson et al.
2008/0056520 A1 * 3/2008 Christensen et al. ..... 381/323
2008/0095390 A1 * 4/2008 Gebert et al. ..... 381/323
2008/0247578 A1 10/2008 Saltykov et al.
2008/0247581 A1 10/2008 Saltykov et al.
2008/0285783 A1 11/2008 Gebert et al.

(Continued)

FOREIGN PATENT DOCUMENTS

DE 3614739 A1 11/1987
DE 60021553 T2 6/2006

*Primary Examiner* — Davetta W Goins
*Assistant Examiner* — Amir Etesam
(74) *Attorney, Agent, or Firm* — Laurence A. Greenberg; Werner H. Stemer; Ralph E. Locher

(57) ABSTRACT

A deep-ear-canal hearing device is worn deep in the ear canal of a user. The hearing device is easy to produce and use, has a small overall size, and can be comfortably worn deep within the auditory canal, in particular in the bony part of the auditory canal as well. The hearing device has a housing, a signal-processing apparatus, and a receiver. The signal-processing apparatus is arranged within the housing. The receiver is merely arranged partly within the housing and another part is arranged outside of the housing. The receiver only being arranged partly within the housing, it is thus not completely surrounded by the housing. Hence, the housing can have a smaller configuration. In the region where the receiver is arranged outside of the housing, the double wall in the form of, the receiver wall and, the housing wall can be dispensed with, which helps in reducing the size.

7 Claims, 2 Drawing Sheets

(56) References Cited

U.S. PATENT DOCUMENTS

| | | | | |
|---|---|---|---|---|
| 2008/0298619 | A1 | 12/2008 | Kral et al. | |
| 2009/0041261 | A1 | 2/2009 | Fickweiler et al. | |
| 2009/0060242 | A1 | 3/2009 | Saltykov et al. | |
| 2009/0067655 | A1* | 3/2009 | Hanisch et al. | 381/323 |
| 2009/0290735 | A1* | 11/2009 | Schanz | 381/318 |
| 2010/0202643 | A1* | 8/2010 | Nielsen | 381/323 |

* cited by examiner

DEEP-EAR-CANAL HEARING DEVICE

CROSS-REFERENCE TO RELATED APPLICATION

This application claims the priority, under 35 U.S.C. §119, of German application DE 10 2010 022 323.9, filed Jun. 1, 2010; the prior application is herewith incorporated by reference in its entirety.

BACKGROUND OF THE INVENTION

Field of the Invention

The invention relates to a deep-ear-canal hearing device, more particularly a hearing aid, to be worn deep in the ear canal of a user.

Hearing devices may be embodied as hearing aids. A hearing aid is used to supply, to a person who is hard of hearing, acoustic surroundings signals, which have been processed and amplified for the purpose of compensating or treating the respective auditory defect. In principle, the hearing aid consists of one or more input transducers, a signal-processing apparatus, an amplification apparatus, and an output transducer. In general, the input transducer is a sound receiver, e.g. a microphone, and/or an electromagnetic receiver, e.g. an induction coil. The output-signal generator is generally implemented as an electroacoustic transducer, e.g. a miniaturized loudspeaker, or as an electromechanical transducer, e.g. a bone conduction receiver. It is also referred to as a receiver. The output-signal generator generates output signals, which are routed to the ear of the patient and should produce an auditory perception for the patient. The amplifier is generally integrated into the signal-processing apparatus. The hearing aid is supplied with current by a battery that has been integrated into the hearing-aid housing. The hearing-aid components are generally arranged on a printed circuit board, or connected thereto, in the form of circuit mounts.

In addition to being embodied as hearing aids, which serve for compensating a reduced or damaged sense of hearing (usually referred to as a hearing loss), hearing devices can also be embodied as so-called tinnitus maskers. Tinnitus maskers are used to treat tinnitus patients. They generate acoustic output signals, which depend on the respective damage to the sense of hearing and, depending on their functional principles, on the surrounding noise and which can contribute to reducing the perception of bothersome tinnitus or other ear sounds. In the following text, the term hearing device should also be understood as meaning tinnitus maskers and other such devices.

Hearing aids are known in various basic housing configurations. In the case of in-the-ear (ITE) hearing aids, a housing containing all functional components including microphone and receiver is mainly worn in the auditory canal. Completely-in-canal (CIC) hearing aids are similar to the ITE hearing aids, but are worn completely within the auditory canal. In the case of behind-the-ear (BTE) hearing aids, a housing with components such as a battery and a signal-processing apparatus is worn behind the ear and a flexible sound tube, also referred to as a tube, routes the acoustic output signals of a receiver from the housing to the auditory canal. Receiver-in-canal behind-the-ear (RIC-BTE) hearing aids resemble the BTE hearing aids, but the receiver is worn in the auditory canal and, instead of a sound tube, a flexible receiver tube routes electrical signals to the receiver in place of acoustic signals, which receiver is attached to the front of the receiver tube. What is common to all housing configurations is that housings that are as small as possible are sought after in order to increase the wearing comfort and reduce the visibility of the hearing aid for cosmetic reasons.

Deep-ear-canal hearing aids resemble the CIC hearing aids. However, whereas CIC hearing aids are generally worn in the outer part of the outer auditory canal, deep-ear-canal hearing aids are pushed closer to the eardrum and are at least partly worn in the inner part of the outer auditory canal. The outer auditory canal is a canal covered in skin and connects the auricle to the eardrum. In the outer, distal part of the auditory canal, which directly adjoins the auricle, this canal is formed by elastic cartilage. In the inner, proximal part, the canal is formed by the temporal bone and therefore consists of bone. The parts of the auditory canal respectively made of cartilage and bone are slightly angled with respect to one another such that they include an angle that differs from person to person. The bony part of the auditory canal in particular is relatively sensitive to pressure and touch. Deep-ear-canal hearing aids are at least worn in part in the sensitive bony part of the auditory canal. Moreover, the hearing aids have to pass the aforementioned kink when being pushed into the bony part of the auditory canal; this may be difficult, depending on the angle of the kink. Moreover, small diameters and wound shapes of the auditory canal can further impede the pushing forward of the aid. Deep-ear-canal hearing aids must therefore be very small.

U.S. Pat. No. 6,865,279 B2 discloses an ear-canal hearing aid, which is embodied in a flexibly bendable fashion in order to be able to adapt to the auditory canal. The electronic components of the hearing aid are arranged in different housing parts that can be flexibly bent with respect to one another. The flexible bending connection is subject to elastic restoration forces that, depending on the fit in the auditory canal, cause pressure on the auditory-canal wall by the hearing aid, which pressure is perceived as uncomfortable.

U.S. patent publication No. 2007/0036379 A1 discloses a CIC hearing aid to be worn in the bony part of the auditory canal. In order to improve the fit in the auditory canal, the housing of the hearing aid likewise has a flexibly bendable section.

SUMMARY OF THE INVENTION

It is accordingly an object of the invention to provide a deep-ear-canal hearing device which overcomes the above-mentioned disadvantages of the prior art devices of this general type, that is easy to produce and use, has a small overall size, and can be comfortably worn deep within the auditory canal, in particular in the bony part of the auditory canal as well.

A basic idea of the invention consists of a hearing device to be worn in the ear canal, with a housing, a signal-processing apparatus, and a receiver. The signal-processing apparatus is arranged within the housing. The receiver is arranged partly within the housing and partly outside of the housing.

As a result of the receiver only being arranged partly within the housing, it is thus not completely surrounded by the housing. Hence, the housing can, overall, have a smaller design. In the region where the receiver is arranged outside of the housing, the double wall in the form of, firstly, the receiver wall and, secondly, the housing wall can be dispensed with, which further helps in reducing the overall size. Particularly in the region of the hearing device to be worn proximally, which according to the definition can be introduced up into the bony part of an auditory canal, any reduction in the overall size is helpful in order to ease the introduction of the hearing device and avoid irritations in this sensitive part of the auditory canal as a result of permanently wearing the hearing device therein. Additionally, depending on the embodiment, the arrangement of the receiver, which is merely partly provided within the housing, may provide for a less complicated production because the receiver is not assembled in an arrangement completely surrounded by the housing and hence, depending on the embodiment, the receiver can, e.g. for the purposes of servicing, also subsequently be accessible from outside of the housing or be able to be replaced.

In an advantageous development, the receiver is arranged within an opening of the housing. Thus, depending on the embodiment of the opening, the receiver is not only accessible from the outside in the part arranged outside of the housing, but can also be assembled or removed and replaced from the outside, without having to open the housing.

In a further advantageous development, the receiver has a projection, e.g. a circumferential collar, on its external circumference. The projection is in mutual engagement with an undercut in the opening, e.g. a circumferential groove. The undercut is configured such that the receiver is secured against sliding out of the opening as a result of the mutual engagement. Such an interaction between projection and undercut with a groove-spring connection constitutes a simple and secure mechanical attachment that affords the possibility of dispensing with a more complicated attachment of the receiver, e.g. by adhesive bonding.

Other features which are considered as characteristic for the invention are set forth in the appended claims.

Although the invention is illustrated and described herein as embodied in a deep-ear-canal hearing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
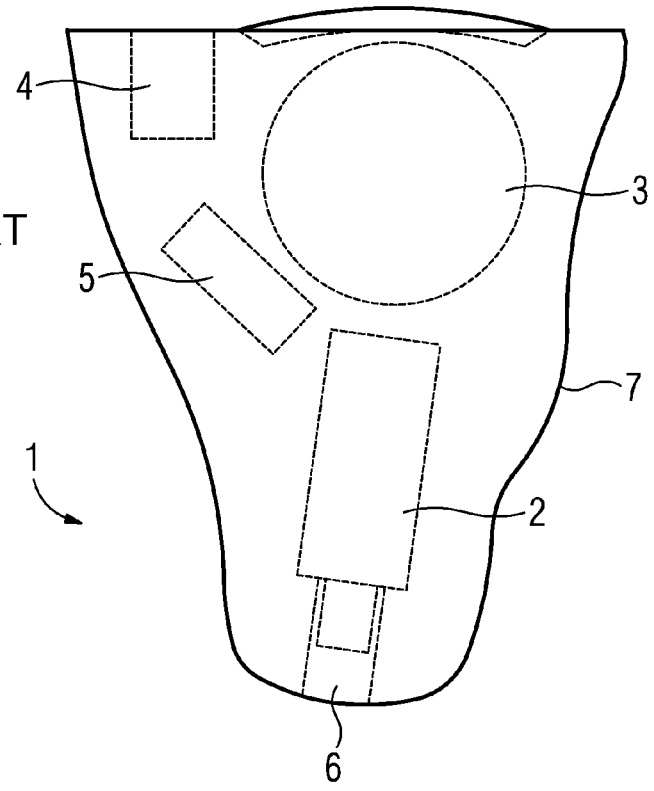
FIG. 1 PRIOR ART
FIG. 1 is an illustration showing a hearing device according to the prior art.

Referring now to the figures of the drawing in detail and first, particularly, to FIG. 1 thereof, there is shown schematically a hearing device, which is embodied as an ear-canal hearing aid 1, according to the prior art. The hearing device contains a housing 7, which has a housing shape suitable for being inserted and worn in the auditory canal. Depending on the size, shape and diameter of the housing 7, the hearing aid 1 can be inserted to a greater or lesser extent into the auditory canal of a hearing-aid wearer. In the case of sufficiently small dimensions, the hearing aid 1 can be inserted up to or into the bony part of the auditory canal, and so in this case a deep-ear-canal hearing aid is present.

The housing 7 is generally made of plastic and can be individually fitted to the contours of an auditory canal of a hearing-aid wearer. For this purpose, the housing may, for example after acquiring 3D data of the auditory canal, be produced in accordance with this data by an injection-molding method or using a rapid prototyping technique according to a rapid shell manufacturing (RSM) method. In order to increase the wearing comfort, the external circumference of the housing 7 may have a flexible design or have a flexible covering or casing. By way of example, silicone gels may be considered as soft and flexible material that is suitable for this purpose.

A microphone 4 for recording surrounding sounds and converting them into electrical signals is arranged in the housing 7. On the output side, the microphone 4 is connected to a signal input of a signal-processing apparatus 5, which is likewise arranged in the housing 7. The signal-processing apparatus 5 processes and amplifies signals received from the microphone 4 as per a signal-processing algorithm, which is also referred to as a hearing program. On the output side, the signal-processing apparatus 5 is connected to a receiver 2, which converts the electrical signals received from the signal-processing apparatus 5 into acoustic output signals. The electronic components in the housing 7 of the hearing aid 1 are supplied with the necessary operational energy by a battery 3. The battery 3 may be a disposable battery or a rechargeable battery. The electronic components and battery 3 are interconnected electrically (not illustrated), e.g. by wiring or by a common rigid or flexible circuit mount.

The receiver 2 emits the acoustic output signals to the outside through a receiver opening 6 in the housing 7. The receiver opening 6 is arranged on the side of the housing 7 to be worn proximally in the auditory canal such that the output signals are emitted in the direction of the eardrum of the hearing-aid wearer. The receiver 2 itself is arranged completely within the housing 7. It is merely connected to the outside via the receiver opening 6.

Figure 2:
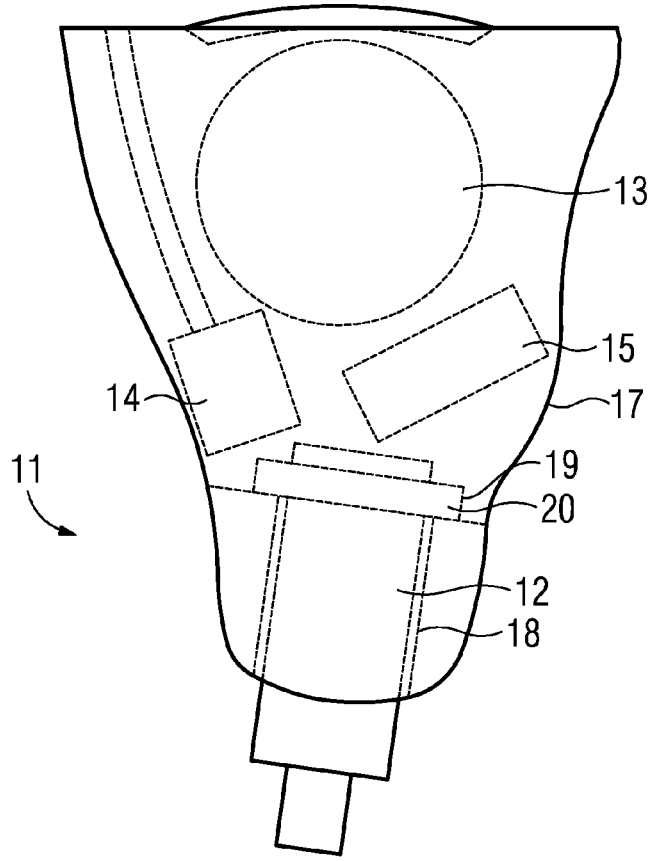
FIG. 2 is an illustration showing a hearing device with a collar-held receiver according to the invention.

FIG. 2 schematically illustrates a hearing device, embodied as a deep-ear-canal hearing aid 11, with a receiver 12 held by a collar 20. In contrast to the previously explained prior art, the receiver 12 is merely partly arranged within the housing 17 of the hearing aid 11, but also partly outside thereof. It protrudes out of the housing 17. The housing 17 merely encompasses the receiver 12 in part, which is why the housing 17 has a correspondingly smaller overall size. The receiver 12 protrudes out of the side of the housing 17 to be worn proximally in the auditory canal, and so the diameter of the hearing aid 11 in the proximal region is reduced to the diameter of the protruding part of the receiver 12.

The receiver 12 is arranged in an opening 18 of the housing 11. A circumferential depression, which is embodied as a circumferential groove 19, is provided in the opening 18. The receiver 12 itself has a circumferential projection, which is embodied as a collar 20, on its outer circumference. The collar 20 is inserted into the groove 19 and is therefore in mutual engagement therewith. Since the groove 19 and the collar 20 are oriented perpendicularly to the longitudinal extent of the opening 18, the receiver 12 is secured against sliding out of the opening 18 as a result of the mutual engagement of the two.

A battery 13, a microphone 14 and a signal-processing apparatus 15 are arranged in the housing 11 in addition to part of the receiver 12. In respect of details relating to the components mentioned above, reference is made to the above explanation relating to the prior art.

Figure 3:
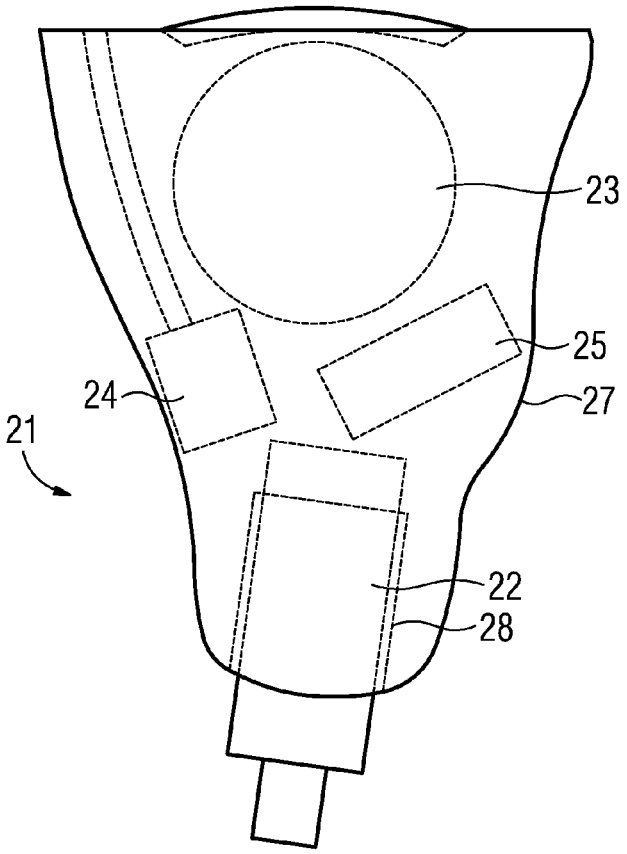
FIG. 3 is an illustration showing the hearing device.

FIG. 3 schematically illustrates a hearing device embodied as a deep-ear-canal hearing aid 21. In respect of details relating to the following electronic components: battery 23, microphone 24, signal-processing apparatus 25, and receiver 22, reference is in turn made to the above explanation relating to the prior art.

In this embodiment too, the receiver 22 is arranged merely partly within the housing 17, and partly outside of the housing 27. However, it is not secured in the opening 28 by a groove-spring mechanism as explained above. Rather, the receiver 22 is either secured in the opening 28 by a (light) friction-locked interference fit or it is adhesively bonded.

Figure 4:
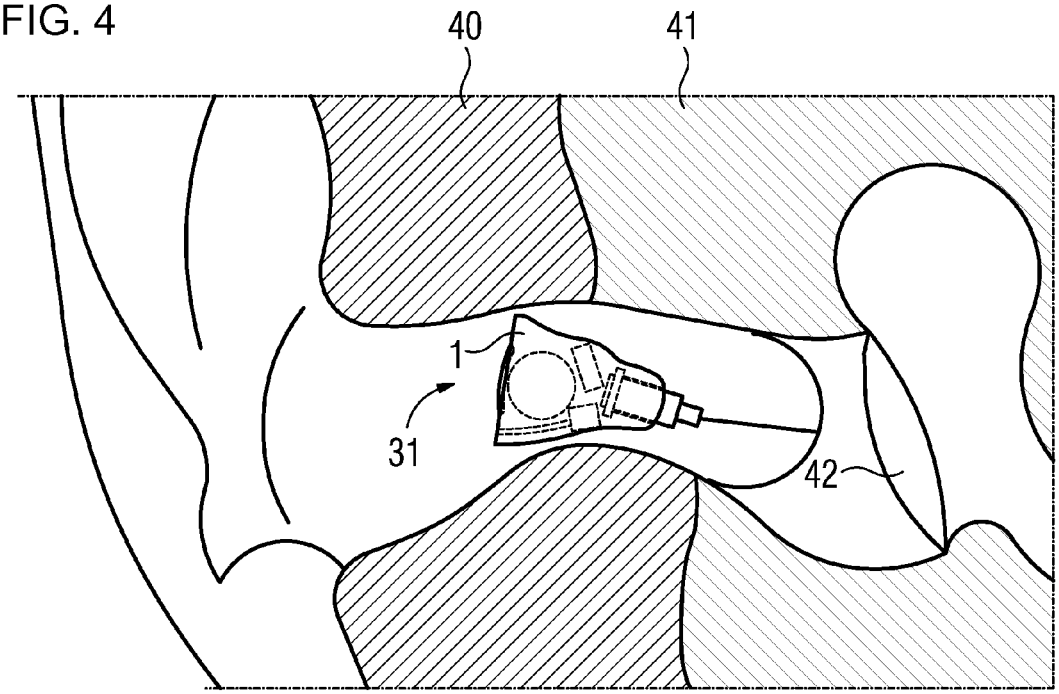
FIG. 4 is an illustration showing the hearing aid in an ear canal.

FIG. 4 schematically illustrates a deep-ear-canal hearing aid 31 with a receiver partly arranged outside of the housing (as explained above) during its intended use in the auditory canal of a hearing-aid wearer. The auditory canal is formed by the cartilage section 40 in the distal region and by the bony section 41 in the proximal region. It is closed off by the eardrum 42 in the proximal direction. The deep-ear-canal hearing aid 31 has been introduced up into the bony auditory-canal section 41. It is mainly the part of the receiver that protrudes from the hearing aid 31 that is pushed up into this section. The receiver has smaller dimensions than the housing of the hearing aid 31, and so it projects freely into the auditory canal, without touching the auditory-canal wall. This positioning avoids an irritation of the sensitive bony auditory-canal section 41 as a result of contact with the hearing aid 31 or the receiver. At the same time, this brings about a positioning deep within the ear canal.

A basic idea of the invention can be summarized as follows: the invention relates to a deep-ear-canal hearing device, more particularly a hearing aid, to be worn deep in the ear canal of a user. The object of the invention consists of specifying a deep-ear-canal hearing device that is easy to produce and use, has a small overall size, and can be comfortably worn deep within the auditory canal, in particular in the bony part of the auditory canal as well. The invention achieves this object by a hearing device with a housing 17, 27, a signal-processing apparatus 15, 25, and a receiver 12, 22. The signal-processing apparatus 15, 25 is arranged within the housing 17, 27. The receiver 12, 22 is merely arranged partly within the housing 17, 27 and another part is arranged outside of the housing 17, 27. As a result of the receiver 12, 22 only being arranged partly within the housing 17, 27, it is thus not completely surrounded by the housing 17, 27. Hence, the housing 17, 27 can, overall, have a smaller design. In the region where the receiver 12, 22 is arranged outside of the housing 17, 27, the double wall in the form of, firstly, the receiver wall and, secondly, the housing wall can be dispensed with, which further helps in reducing the overall size.

The invention claimed is:

1. A hearing device to be worn in an ear canal, the hearing device comprising:

a housing;

a signal-processing apparatus disposed within said housing;

a receiver disposed partly within said housing and partly outside of said housing;

said housing having an opening formed therein and said receiver disposed within said opening, said opening having an undercut, said opening having dimensions such that said receiver can be pushed-in or pulled-out of said housing via said opening; and said receiver having an external circumference with a circumferential collar disposed on said external circumference and extending completely around said external circumference, said circumferential collar being in mutual engagement with said undercut in said opening, said undercut configured such that said receiver is secured against sliding out of said opening as a result of a mutual engagement.

2. The hearing device according to claim 1, wherein said receiver is disposed on a side of said housing to be worn proximally in an auditory canal.

3. The hearing device according to claim 1, wherein said undercut is a circumferential groove.

4. The hearing device according to claim 3, wherein said projection is a circumferential collar.

5. The hearing device according to claim 1, further comprising:

a microphone disposed in said housing; and an energy supply disposed in said housing.

6. The hearing device according to claim 1, wherein the hearing device is a deep-ear-canal hearing aid.

7. The hearing device according to claim 5, wherein said energy supply is a battery.

* * * * *